US007835655B2

(12) United States Patent
Kobashi et al.

(10) Patent No.: US 7,835,655 B2
(45) Date of Patent: Nov. 16, 2010

(54) CHARGER, IMAGE FORMING APPARATUS, AND CHARGE CONTROL METHOD

(75) Inventors: Masaru Kobashi, Matsumoto (JP); Koji Migita, Matsumoto (JP); Masashi Nakatsu, Shiojiri (JP); Shinichi Kamoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 468 days.

(21) Appl. No.: 11/954,741

(22) Filed: Dec. 12, 2007

(65) Prior Publication Data

US 2008/0131154 A1 Jun. 5, 2008

(30) Foreign Application Priority Data

Dec. 12, 2006 (JP) ..... 2006-334497

(51) Int. Cl.
*G03G 15/02* (2006.01)

(52) U.S. Cl. ..... 399/50; 399/71; 399/174; 399/349

(58) Field of Classification Search ..... 399/50, 399/71, 115, 168, 174–176, 349
See application file for complete search history.

(56) References Cited

U.S. PATENT DOCUMENTS 5,751,405 A * 5/1998 Aita et al. ..... 399/150
5,832,336 A * 11/1998 Kawasaki et al. ..... 399/71
6,421,512 B2 * 7/2002 Watanabe et al. ..... 399/149

FOREIGN PATENT DOCUMENTS

JP 10-048916 2/1998
JP 2005-331846 12/2005

* cited by examiner

*Primary Examiner*—David P Porta
*Assistant Examiner*—Benjamin Schmitt
(74) *Attorney, Agent, or Firm*—DLA Piper LLP (US)

(57) ABSTRACT

A charger includes: a first charging member that contacts an image carrier and a second charging member that contacts the image carrier downstream from the first charging member. At the time of image formation, a voltage higher than the discharge start voltage of the first charging member is applied to the first charging member and a voltage lower than the discharge start voltage of the second charging member and lower than the voltage applied to the first charging member is applied to the second charging member, and at the time when an image is not formed, a voltage lower than the discharge start voltage of the first charging member is applied to the first charging member and a voltage higher than the discharge start voltage of the second charging member and higher than the voltage applied to the first charging member is applied to the second charging member.

6 Claims, 7 Drawing Sheets

CHARGER, IMAGE FORMING APPARATUS, AND CHARGE CONTROL METHOD

CROSS-REFERENCE TO RELATED APPLICATIONS

This application is based upon and claims the benefit of priority from prior Japanese Patent Application No. 2006-334497, filed Dec. 12, 2006, the entire content of which is incorporated herein by reference.

BACKGROUND OF THE INVENTION

1. Field of the Invention

The present invention relates to a charger for charging an image carrier, an image forming apparatus of electrophotographic type incorporating the charger, and a charge control method for controlling charging of the image carrier.

2. Description of the Related Art

In a conventional image forming apparatus including an electrophotographic machine, such as an electrostatic copier, a printer, and facsimile, an image is formed as follows. First, after the surface of a photoconductor is uniformly charged by a contact charger, an electrostatic latent image is formed on the surface of the photoconductor by an exposure unit. Then, the electrostatic latent image is developed by a developing unit into a toner image and transferred directly or through an intermediate transfer member onto a transfer material such as a paper by a transfer unit. Finally, the toner image on the transfer medium is fixed by a fixing unit.

There is known, as a conventional image forming apparatus, one provided with a charger that brings two charging members (primary and secondary charging members) into contact with a rotating photoconductor so as to uniformly and satisfactorily charge the surface of the photoconductor (see, e.g., JP-A-2005-331846). The charger of this image forming apparatus uses the secondary charging member provided on the downstream side in the rotational direction of the photoconductor to eliminate irregular charge occurring when the primary charging member provided on the upstream side in the rotational direction of the photoconductor is used to charge the surface of the photoconductor, thereby achieving uniform charge of the photoconductor.

However, in the contact type charge, there may be a case where residual toner particles passing through a cleaner of the photoconductor or other foreign matters are adhered to the charging member to contaminate it, causing irregular charge. In order to cope with this problem, in the charger disclosed in JP-A-2005-331846, at the time of image formation, a voltage whose absolute value is higher than the absolute value of a discharge start voltage Vth1 of the primary charging member is applied to the primary charging member and a voltage whose absolute value is lower than at least the absolute value of a discharge start voltage Vth2 of the secondary charging member is applied to the secondary charging member. Further, at the time of cleaning when an image is not being formed, a voltage which has the same polarity as that applied to the primary charging member at the time of image formation and whose absolute value is lower than the absolute value of the discharge start voltage Vth1 of the primary charging member is applied to the primary charging member and a voltage which has the reverse polarity to that applied to the secondary charging member at the time of image formation and whose absolute value is lower than the absolute value of the discharge start voltage Vth2 of the secondary charging member is applied to the secondary charging member. This configuration enhances cleanability of the secondary charging member, thus making the surface potential of the photoconductor stable.

Then, consider that the cleanability of the secondary charging member is enhanced so as to make the surface potential of the photoconductor stable in the case where the charger disclosed in JP-A-2005-331846 is applied to an image forming apparatus provided with a transfer belt that contacts the photoconductor. However, in the charger disclosed in JP-A-2005-331846, at the time of cleaning, a voltage whose absolute value is lower than the absolute value of the discharge start voltage Vth2 of the secondary charging member is applied to the secondary charging member. When such a low voltage is applied to the secondary charging member, an electrical discharge does not occur from the secondary charging member to the photoconductor, with the result that the surface potential of the photoconductor becomes substantially 0 V. Therefore, a charged part and non-charged part are formed on the photoconductor contacting the secondary charging member. When the charged part and non-charged part are formed on the photoconductor, a difference is generated in an electrostatic adsorption force between the photoconductor and the transfer belt. As a result, a difference is caused in the moving speed of the transfer belt, causing banding.

SUMMARY OF THE INVENTION

An object of the present invention is to provide a charger capable of preventing, in charging of an image carrier using a primary and secondary charging members, banding occurring at the time when a secondary charging member is cleaned, an image forming apparatus incorporating the charger, and a charge control method.

In order to achieve the above object, according to the present invention, at the cleaning time when an image is not formed, the controller applies, to the first charging member, a voltage whose absolute value is lower than the absolute value of the discharge start voltage of the first charging member and applies, to the second charging member, a voltage whose absolute value is higher than the absolute value of the discharge start voltage of the second charging member and whose absolute value is higher than voltage applied to the first charging member. That is, the magnitude relation in the absolute values of the application voltages to the primary and secondary charging members is reversed between at the image formation time and at the cleaning time. As a result, foreign matters such as residual toner adhered to the secondary charging member can be removed therefrom and moved to the image carrier. This allows achievement of satisfactory charge of the image carrier over a long period of time, thereby effectively realizing high quality image formation.

In addition, at the time of cleaning the secondary charging member, the surface potential of the image carrier brought into contact with the secondary charging member can be maintained at a constant value. This prevents formation of a charged part and non-charged part on the image carrier, making the electrostatic adsorption force between the image carrier and a transfer belt uniform. As a result, a difference is not caused in moving speed of the transfer belt, thereby preventing banding and resist shift.

BRIEF DESCRIPTION OF THE DRAWINGS

The invention will be described with reference to the accompanying drawings, wherein like numbers reference like elements.

DETAILED DESCRIPTION OF THE PREFERRED EMBODIMENTS

A preferred embodiment of the present invention will be described below with reference to the accompanying drawings.

Figure 1:
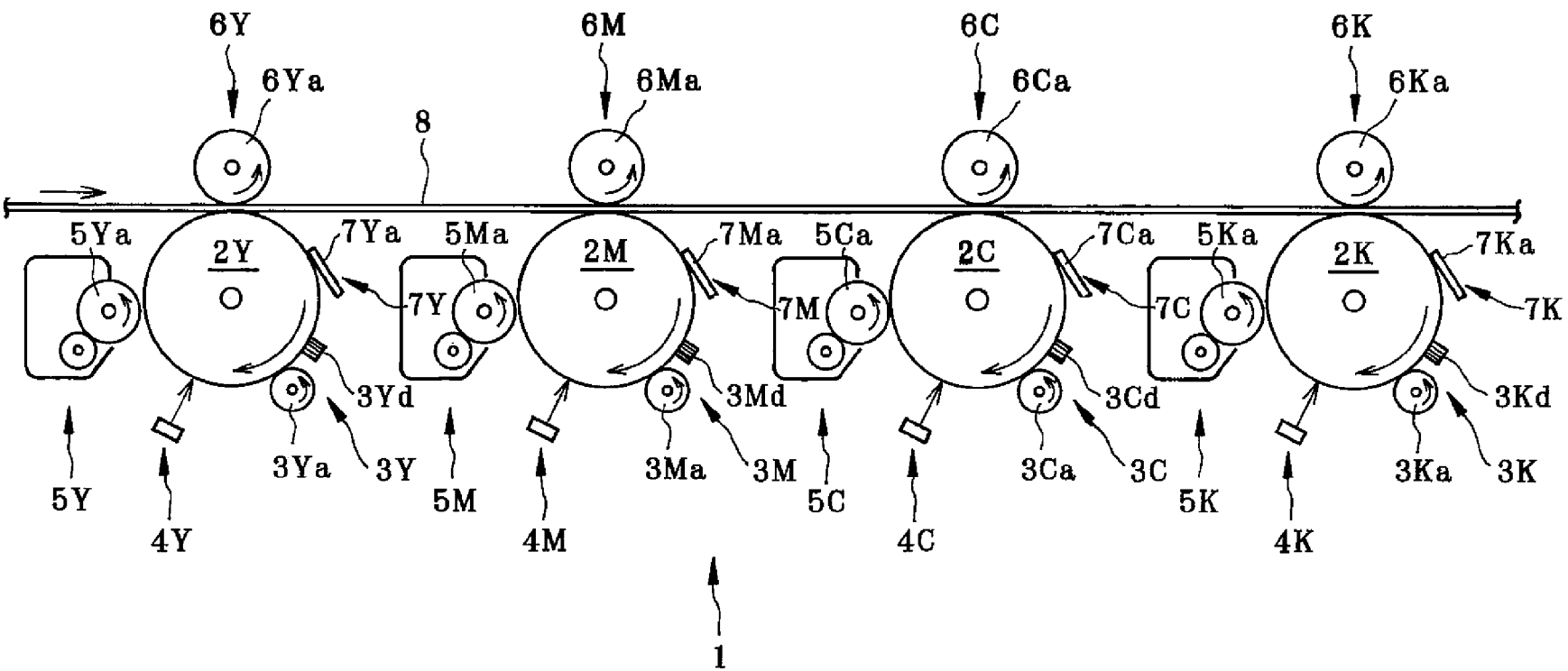
FIG. 1 is a view schematically and partially showing an example of an embodiment of an image forming apparatus according to the present invention.

FIG. 1 is a view schematically and partially showing an example of an embodiment of an image forming apparatus according to the present invention.

As shown in FIG. 1, an image forming apparatus 1 is constituted as a full color tandem type image forming apparatus having toner image forming units of yellow (Y), magenta (M), cyan (C), and black (K). The image forming apparatus 1 includes: image carriers (e.g., photoconductor drums) 2Y, 2M, 2C, 2K which are configured to form electrostatic latent images and toner images of respective colors; chargers 3Y, 3M, 3C, 3K which are sequentially disposed at positions opposite to the image carriers 2Y, 2M, 2C, 2K in this order from the upstream side in the rotational direction a of the image carriers 2Y, 2M, 2C, 2K and which are configured to charge the respective image carriers 2Y, 2M, 2C, 2K; image writing units 4Y, 4M, 4C, 4K which are configured to write electrostatic latent images on the respective image carriers 2Y, 2M, 2C, 2K; developing units 5Y, 5M, 5C, 5K which are configured to develop the electrostatic latent images on the respective image carriers 2Y, 2M, 2C, 2K using toner (developer) of respective colors to form toner images; primary transfer units 6Y, 6M, 6C, 6K which are configured to primary transfer the toner images on the respective image carriers 2Y, 2M, 2C, 2K; and clears 7Y, 7M, 7C, 7K which are configured to clean the respective image carriers 2Y, 2M, 2C, 2K.

The image carriers 2Y, 2M, 2C, 2K for respective colors have the same configurations. The same is applied to the chargers 3Y, 3M, 3C, 3K, image writing units 4Y, 4M, 4C, 4K, developing units 5Y, 5M, 5C, 5K, primary transfer units 6Y, 6M, 6C, 6K, and clears 7Y, 7M, 7C, 7K.

Figure 2:
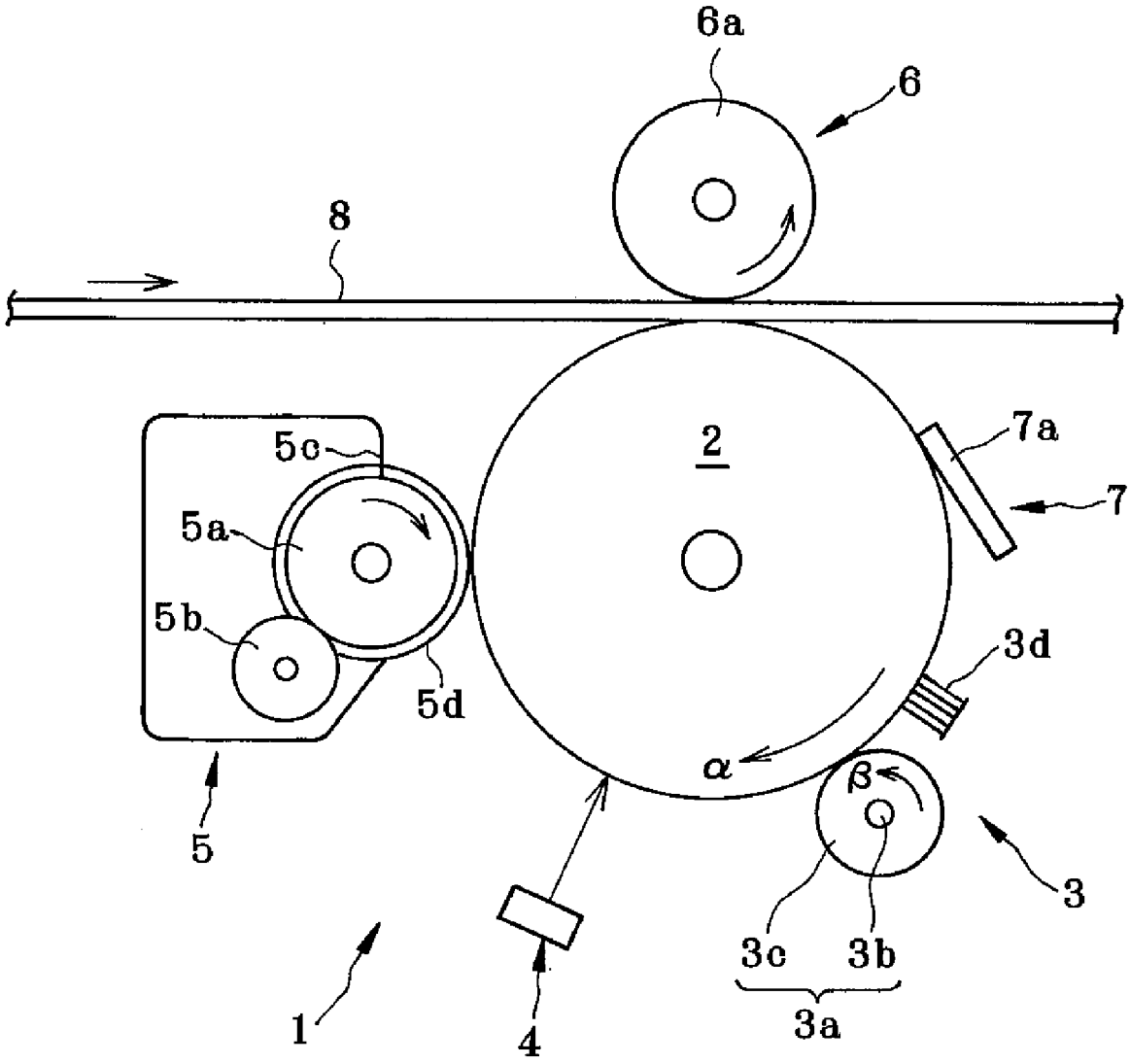
FIG. 2 is a view for explaining units provided for each color in the image formation apparatus of FIG. 1, the units provided for respective four colors having the same configuration as each other.

FIG. 2 is a view for explaining the above-mentioned units provided for each color. As described above, the units provided for respective four colors have the same configuration as one another. Note that, in FIG. 2, symbols Y, M, C, K are omitted.

As shown in FIG. 2, the charger 3 includes a charging roller (CR) 3*a* (secondary charging member) for charging the image carrier 2 and a charging brush (CB) 3*d* (primary charging member) for charging the image carrier 2. The charging brush 3*d* is disposed on the upstream side relative to the charging roller 3*a* in the rotational direction $\alpha$ of the image carrier 2. The charging roller 3*a* is brought into contact with the peripheral surface of the image carrier 2 and rotated in the direction $\beta$ (counterclockwise direction in FIG. 1) opposite to the rotational direction $\alpha$ of the image carrier 2.

The charging roller 3*a* may be a known one. That is, the charging roller 3*a* can be produced by a method disclosed in, e.g., JP-A-10-48916. The charging roller 3*a* is constituted by forming a cylindrical-shaped conductive elastomer layer 3*c*, such as a conductive rubber, whose superficial portion is made of a resistive layer having a gradient surface structure, on a metallic shaft 3*b* made of stainless. The conductive elastomer layer 3*c* has, throughout the axial direction thereof, a constant outer diameter and a constant electric resistance value.

The following is a production method of an example of the charging roller 3*a* having the conductive elastomer layer 3*c*. Epichlorohydrin rubber (Epichlomer CG-102, product of Daiso Co., Ltd) (100 parts by weight), sodium trifluoroacetate (0.3 parts by weight) serving as a conductive material, zinc oxide (ZnO) (5 parts by weight), and 2-mercaptoimidazoline (Accel-22) (2 parts by weight) serving as a vulcanizing agent were kneaded by means of a roll mixer, and the kneaded product was press-formed on the surface of a metallic shaft (diameter 6 mm). The thus-coated shaft was polished, to thereby adjust the diameter to 12 mm, producing a roller in which a conductive rubber elastic member is formed on the surface of the shaft.

The charging brush 3*d* has a plurality of bristles and supported by a not-shown brush supporting member. The leading ends of the brush bristles are brought into contact with the peripheral surface of the image carrier 2. The charging brush 3*d* may also be a known one. An example of the charging brush 3*d* is shown in Table 1.

TABLE 1

| | Material | Fineness | Density | Original yarn resistance | Pile length | Dimension |
|---|---|---|---|---|---|---|
| Brush 1 | 6 Nylon | 220T/96F | 240 kf/inch$^2$ | 7.1 Log$\Omega$ | 5 mm | 300 mm × 5 mm × 5 mm |

As shown in Table 1, the bristles of the brush 1 which is an example of the charging brush 3*d* are made of 6 nylon and having a fineness of 220 T/96 F, density of 240 kf/inch$^2$, original yarn resistance of 7.1 Log $\Omega$, and pile length of 5 mm. The brush 1 has a length of 300 mm, width of 5 mm, and height of 5 mm. This brush 1 is manufactured by Toeisangyo Co., Ltd.

In the image forming apparatus 1, the image carrier 2 is first uniformly charged by the charging brush 3*d* (primary charge) and then uniformly charged by the charging roller 3*a* (secondary charge).

The image writing unit 4 writes an electrostatic latent image on the image carrier 2 charged by the charger 3 using a laser light or the like. The developing unit 5 includes a developing roller 5*a*, a toner supply roller 5*b*, and a toner layer thickness regulation member 5*c*. The developing roller 5*a* has, at its both end portions, ring members 5*d* (in FIG. 2, only one side ring member 5*d* is shown). The ring member 5*d* serves as a member for regulating a distance between the shafts of the developing roller and image carrier. That is, the contact of the ring member 5*d* with the peripheral surface of the image carrier 2 regulates the distance between the shaft center of the developing roller 5*a* and shaft center of the image carrier 2. As a result, a predetermined development gap is provided between the peripheral surface of the developing roller 5*a* and peripheral surface of the image carrier 2.

Not-shown toner (developer) is supplied by the toner supply roller 5*b* onto the developing roller 5*a* and, then, the toner on the developing roller 5*a* is conveyed to the image carrier 2 while the thickness thereof is regulated by the toner layer thickness regulation member 5*c*. After that, the electrostatic latent image on the image carrier 2 is subjected to non-contact jumping development, whereby a toner image is formed on the image carrier 2.

The primary transfer unit 6 has a primary transfer roller 6*a*, by which the toner image on the image carrier 2 is transferred onto an intermediate transfer medium 8 which is, e.g., an intermediate transfer belt.

The cleaning unit 7 has a cleaning blade 7*a* made of an elastic material such as a rubber. This cleaning blade 7*a* is attached to the apparatus body through a not-shown blade supporting member. The cleaning blade 7*a* is always brought into press-contact with the peripheral surface of the image carrier 2. The peripheral surface of the image carrier 2 is thus cleaned by the cleaning blade 7*a*, whereby the residual toner on the image carrier 2 after transfer operation is removed and collected in a not-shown toner collector.

Although not shown, the image forming apparatus 1 further includes at least a known secondary transfer unit for secondary transferring the toner image that has been transferred onto the intermediate transfer medium 8 onto a transfer material such as a paper and a known fixing unit for heat-and-pressure fixing the toner image that has been secondary transferred onto the transfer material.

An image formation operation of the image forming apparatus 1 will next be described with reference to FIG. 1. The following description is made with the color symbols Y, M, C, K given to the reference numerals of the corresponding components provided for respective colors.

In FIG. 1, the image carrier 2Y for yellow is uniformly primary charged by the charging brush 3Yd and, then, uniformly secondary charged by the charging roller 3Ya. Subsequently, after an electrostatic latent image is written onto the image carrier 2Y by the image writing unit 4Y, this electrostatic latent image is developed by toner conveyed by the developing roller 5Ya of the developing unit 5Y. In this manner, a toner image of yellow (Y) is formed on the image carrier 2Y. With predetermined time lags, toner images of the other colors M, C, K are sequentially formed onto the image carriers 2M, 2C, 2K.

The toner image of yellow (Y) on the image carrier 2Y is primary transferred onto the intermediate transfer medium 8 by the primary transfer unit 6Y and, then, the toner image of yellow (Y) on the intermediate transfer medium 8 is conveyed toward the primary transfer unit 6M. Then, a toner image of magenta (M) on the image carrier 2M is primary transferred, by the primary transfer unit 6M, onto a predetermined position on the intermediate transfer medium 8 in a superimposed manner on the toner image of yellow (Y). The toner image on the intermediate transfer medium 8 obtained by superimposing the toner images of yellow (Y) and magenta (M) is conveyed toward the primary transfer unit 6C. Then, a toner image of cyan (C) on the image carrier 2C is primary transferred, by the primary transfer unit 6C, onto a predetermined position on the intermediate transfer medium 8 in a superimposed manner on the toner image of yellow (Y) and magenta (M). Subsequently, the toner image on the intermediate transfer medium 8 obtained by superimposing the toner images of yellow (Y), magenta (M), and cyan (C) is conveyed toward the primary transfer unit 6K. Then, a toner image of black (K) on the image carrier 2K is primary transferred, by the primary transfer unit 6K, onto a predetermined position on the intermediate transfer medium 8 in a superimposed manner on the toner image of yellow (Y), magenta (M), and cyan (C). In this manner, a full color toner image is formed on the intermediate transfer medium 8.

The full color toner image on the intermediate transfer medium 8 is secondary transferred onto a transfer material such as a paper by the secondary transfer unit and, then, the full color toner image on the transfer material is heat-and-pressure fixed by the fixing unit. In this manner, a full color toner image is formed on the transfer material.

In the charger 3 of the image forming apparatus 1, a secondary charging member cleaning means is provided for removing foreign matters adhered to the charging roller 3*a* (secondary charging member). The secondary charging member cleaning means controls the application voltage to the charging roller 3*a* (secondary charging member) to thereby clean the charging roller 3*a* by a bias cleaning process.

Figure 3:
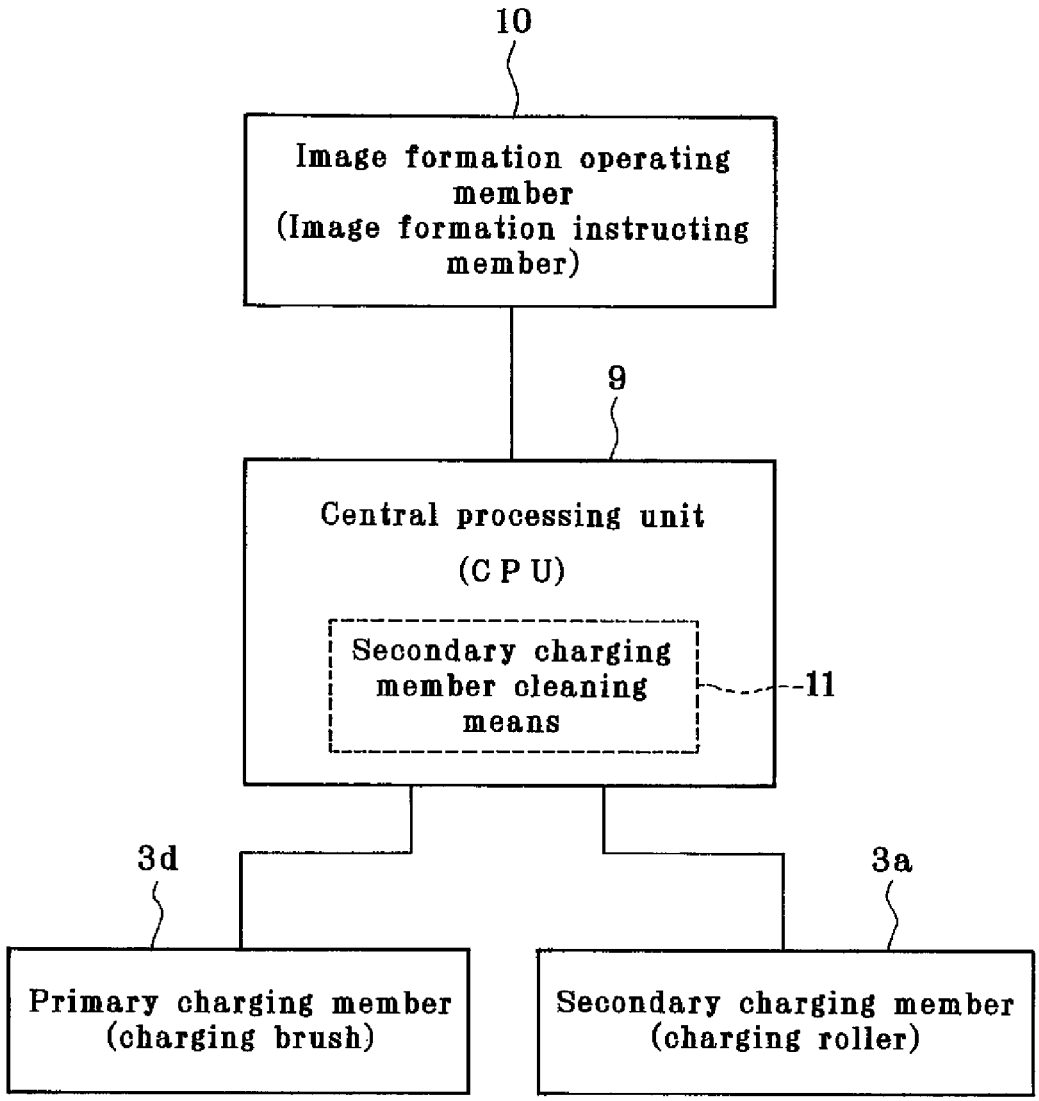
FIG. 3 is a block diagram showing a configuration for voltage application to primary and secondary charging members of a charger.

FIG. 3 is a block diagram showing a configuration for voltage application to primary and secondary charging members of the charger.

As shown in FIG. 3, in order to apply a charging voltage to the charging brush 3*d* and charging roller 3*a*, the image forming apparatus 1 includes a central processing unit (CPU) 9 and an image formation operating member (image formation instructing member) 10, such as an operation key provided on a console panel or touch key on an operation screen, for outputting an operation instruction (image formation instruction) to allow the image forming apparatus 1 to perform an image formation operation.

Further, in order to clean the charging roller 3*a* by a bias cleaning process, the CPU 9 includes a secondary charging member cleaning means 11. The secondary charging member cleaning means 11 controls the application voltages to the charging brush 3*d* and charging roller 3*a* at the time of cleaning of the charging roller 3*a* to thereby conduct bias cleaning.

An example of a negative charge of the image carrier 2 will concretely be described. It is assumed here that the discharge start voltage of the charging brush 3*d* and charging roller 3*a* is set to the same value (discharge start voltage Vth). At the time of image formation, a (negative) voltage whose absolute value is higher than the absolute value of the (negative) discharge start voltage Vth (V) is applied to the charging brush 3*d*. Also, at the time of image formation, a (negative) voltage whose absolute value is lower than the absolute value of the (negative) discharge start voltage Vth (V) is applied to the charging roller 3*a*. In this case, at the time of image formation, the application voltage to the charging roller 3*a* may be set to 0 V.

On the other hand, at the time of cleaning of the charging roller 3*a* when an image is not being formed, a (negative) voltage whose absolute value is lower than the discharge start voltage Vth (V) or 0 V is applied to the charging brush 3*d*. Also, at the time of cleaning of the charging roller 3*a* when an image is not being formed, a (negative) voltage whose absolute value is higher than the discharge start voltage Vth (V) is applied to the charging roller 3*a*.

As described above, the magnitude relation in the absolute values of the application voltages to the charging brush 3*d* and charging roller 3*a* is reversed between at the image formation time and at the cleaning time of the charging roller 3*a*. In the image forming apparatus 1, the voltage control for cleaning the charging roller 3*a* is performed at the time when an image is not formed.

Figure 4:
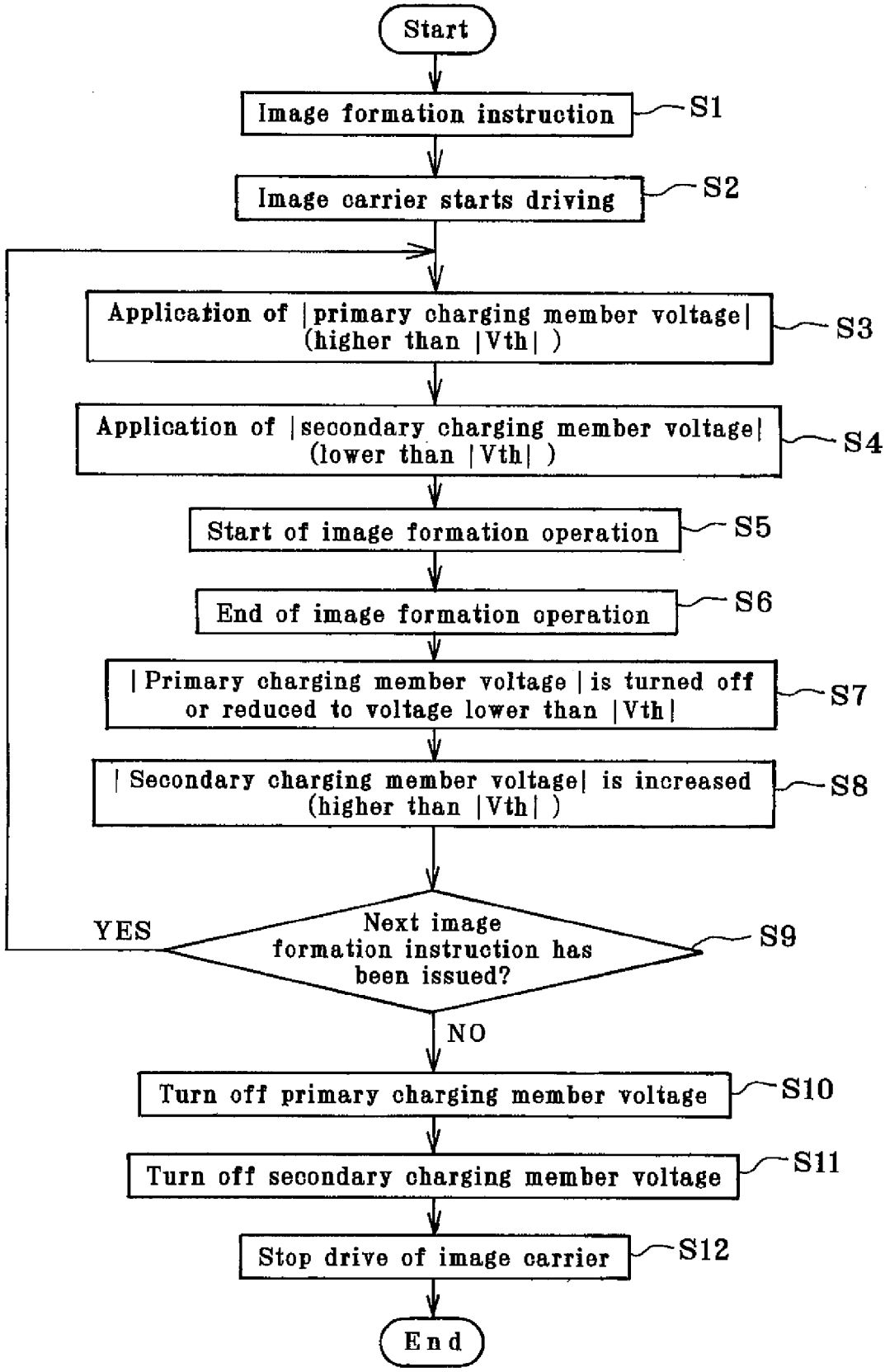
FIG. 4 is a flowchart showing a procedure of cleaning a charging roller by a voltage control.

FIG. 4 is a flowchart showing a procedure of cleaning the charging roller by the voltage control.

As shown in FIG. 4, when an image formation instruction is issued in step S1, the image carrier 2 starts driving in step S2. Subsequently, in step S3, a voltage whose absolute value is higher than the absolute value of the discharge start voltage Vth (V) is applied to the charging brush (primary charging member) 3*d* and, in step S4, a voltage whose absolute value is lower than the absolute value of the discharge start voltage Vth (V) is applied to the charging roller (secondary charging member) 3*a*. At this time, the discharge start voltage Vth (V) is negative. As a result, the image carrier 2 is primary charged by the charging brush 3*d* and, then, secondary charged by the charging roller 3*a*, whereby the image carrier 2 is uniformly charged.

In step S5, an image formation operation is started. After completion of the image formation operation in step S6, the voltage of the charging brush 3*d* is turned off or reduced to a voltage whose absolute value is lower than the absolute value of the discharge start voltage Vth (V) in step S7. Then, in step S8, the voltage of the charging roller 3*a* is increased to a (negative) voltage whose absolute value is higher than the absolute value of the discharge start voltage Vth (V). That is, the voltages of the charging brush 3*d* and charging roller 3*a* at the cleaning time of the charging roller 3*a* are controlled in a reversed fashion in their absolute values to the voltages of the charging brush 3*d* and charging roller 3*a* at the image formation time. In this case, it is preferable that a voltage equal to or higher than the absolute value of a (negative) development bias be applied to the charging roller 3*a*. Then, foreign matters such as residual toner adhered to the charging roller 3*a* are moved to the image carrier 2 and adhered thereto by an electrostatic adsorption force. As a result, the foreign matters adhered to the image carrier 2 are removed by the cleaning blade 7*a* of the cleaning unit 7 and collected in the toner collector of the cleaning unit 7.

After completion of the cleaning of the charging roller 3*a* by a voltage whose absolute value has been increased in step S8, it is determined whether there has been issued a next image formation instruction in step S9. When it is determined that there has been issued a next instruction like the case of a continuous image formation operation for printing a predetermined number of papers, the flow shifts to step S3, and step S3 and subsequent steps are performed.

When it is determined that there has not been issued a next image formation instruction in step S9, the voltage of the charging brush 3*d* is turned off in step S10 (in the case where the voltage of the charging brush 3*d* is turned off in step S7, the step S10 is skipped). Subsequently, in step S11, the voltage of the charging roller 3*a* is turned off and, then, the drive of the image carrier 2 is stopped in step S12. Thus, the image formation operation according to the image formation instruction issued in step S1 is completed.

Figure 5:
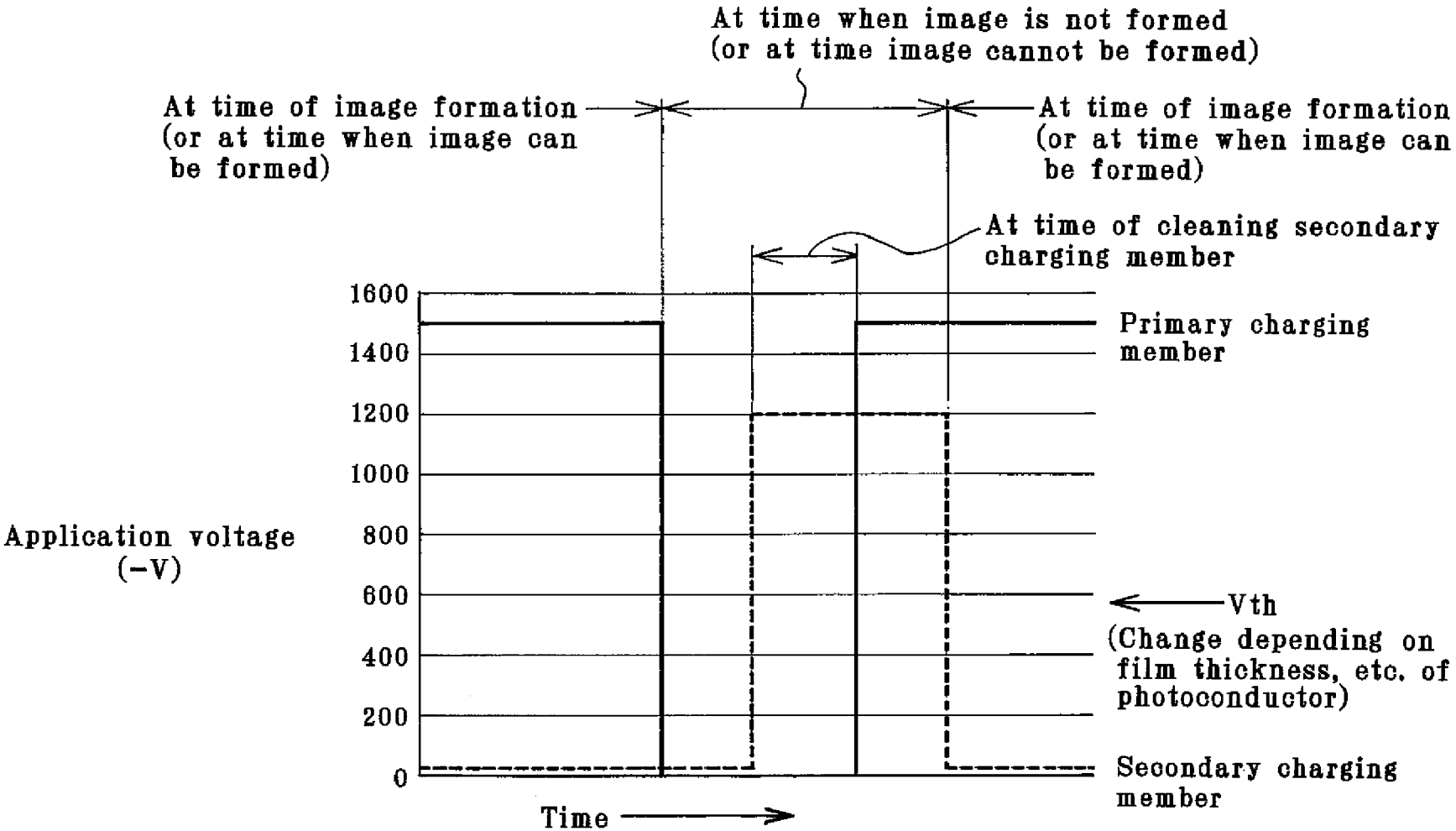
FIG. 5 is a view showing voltage application to the primary and secondary charging member at the time of image formation and at the time of cleaning.

FIG. 5 is a view showing an example of a time-course change in voltage application to the primary and secondary charging member at the time where charging bias is changed from the image formation mode to cleaning mode for cleaning the image carrier under a negative charge condition.

As shown in FIG. 5, at the image formation time (or at the time when an image can be formed), the application voltage to the charging brush 3*d* (primary charging member) denoted by a solid line is set to −1500 V higher than the discharge start voltage Vth (V) which is slightly lower than −600 V. The application voltage to the charging roller 3*a* (secondary charging member) denoted by a dotted line is set to substantially 0 V whose absolute value is lower than the absolute value of the discharge start voltage Vth (V). At the time when an image is not formed (or at the time an image cannot be formed) after completion of the image formation, the application voltage to the charging brush 3*d* is set to 0 V whose absolute value is lower than the absolute value of the discharge start voltage Vth (V), and application voltage to the charging roller 3*a* is set to −1200 V whose absolute value is higher than the absolute value of the discharge start voltage Vth (V). Then, when cleaning of the charging roller 3*a* is started, the surface of the image carrier 2 is charged at −1200 V.

As described above, the magnitude relation in the absolute values of the application voltages to the charging brush 3*d* and charging roller 3*a* is reversed between at the image formation time and at the cleaning time of the charging roller 3*a*. Also, at the time of cleaning the charging roller 3*a*, the surface of the image carrier 2 is charged at −1200 V whose absolute value is higher than the absolute value of the discharge start voltage Vth (V). As described above, in the charger 3, the absolute value of the surface potential of the image carrier 2 is maintained at a value higher than a certain value also at the time of cleaning the charging roller 3*a*.

A description will be made of a case where the bias cleaning of the charging roller 3*a* is applied to the full color tandem type image forming apparatus of FIG. 1.

Figure 6:
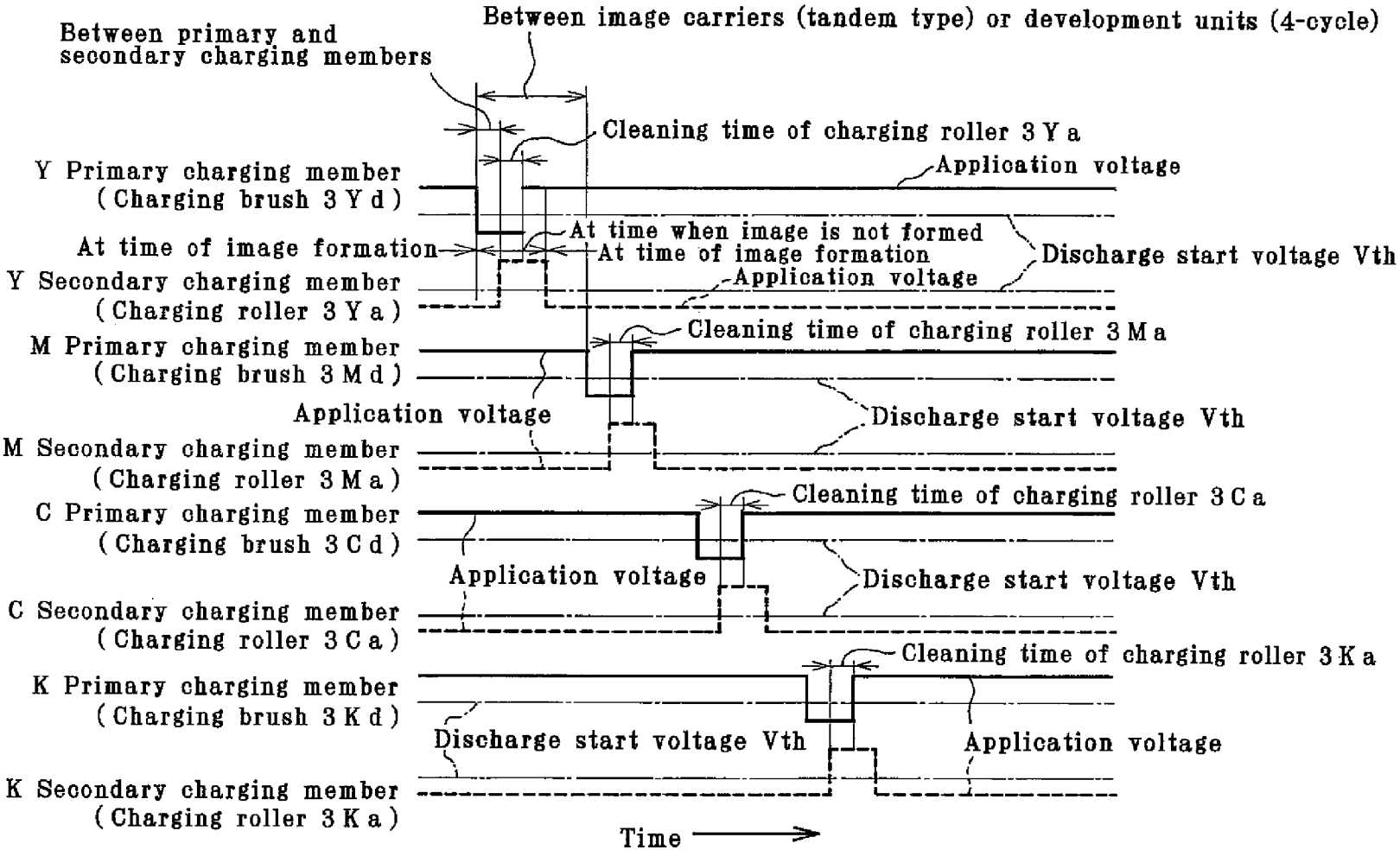
FIG. 6 is a timing chart in the case where bias cleaning is conducted at the timing at which a paper is fed from one color unit to another.

FIG. 6 is a timing chart in the case where bias cleaning is conducted according to the flowchart shown in FIG. 4 in the tandem type image forming apparatus of FIG. 1 at the timing at which a paper is fed from one color unit to another (at the timing between the end of formation of an image of one color and start of formation of an image of next color). The bias cleaning in respective color units are conducted with predetermined time lags. The application voltage shown in FIG. 6, which is applied to the charging brushes (primary charging members) 3Yd, 3Md, 3Cd, 3Kd and charging rollers (secondary charging members) 3Ya, 3Ma, 3Ca, 3Ka, is the same voltage (−V) as the application voltage shown in FIG. 5.

As shown in FIG. 6, at the time of image formation, a voltage whose absolute value is higher than the absolute value of the discharge start voltage Vth (V) is applied to the respective charging brushes (primary charging members) 3Yd, 3Md, 3Cd, 3Kd, and a voltage whose absolute value is lower than the absolute value of the discharge start voltage Vth (V) is applied to the charging rollers (secondary charging members) 3Ya, 3Ma, 3Ca, 3Ka. Then, the image formation operations of respective colors are sequentially started with predetermined time lags. When an image of yellow (Y) has been formed, the processing (step S7 in FIG. 4) for the charging brush 3Yd of yellow (Y) is performed, that is, the application voltage to the charging brush 3Yd is reduced to a voltage whose absolute value is lower than the absolute value of the discharge start voltage Vth (V). Subsequently, the processing (step S8 in FIG. 4) for the charging roller 3Ya of yellow (Y) is performed, that is, the application voltage to the charging roller 3Ya is increased to a (negative) voltage whose absolute value is higher than the absolute value of the discharge start voltage Vth (V). This triggers the bias cleaning of the charging roller 3Ya of yellow (Y).

In the case where there has been issued a next image formation instruction after the bias cleaning of the charging roller 3Ya is completed, a voltage whose absolute value is higher than the absolute value of the discharge start voltage Vth (V) is applied once again to the charging brush 3Yd, as shown in FIG. 6. Further, a voltage whose absolute value is lower than the absolute value of the discharge start voltage Vth (V) is applied once again to the charging roller 3Ya. As a result, the image carrier 2Y is uniformly charged for the next image formation operation. In the case where there has not been issued a next image formation instruction, i.e., the current image formation operation is the last one, the voltages applied to the charging brush 3Yd and charging roller 3Ya are turned off, that is, no voltage is applied to these charging members. Therefore, charging operation for the surface of the image carrier 2Y of yellow (Y) for image formation is not performed.

Subsequently, when the time corresponding to the distance between adjacent two image carriers (image carrier of yellow (Y) and image carrier of magenta (M)) has elapsed, an image of magenta (M) has been formed. Then, as in the case of the yellow (Y), the application voltage to the charging brush 3Md of magenta (M) is reduced to a voltage whose absolute value is lower than the absolute value of the discharge start voltage Vth (V). Subsequently, the application voltage to the charging roller 3Ma of magenta (M) is increased to a (negative) voltage whose absolute value is higher than the absolute value of the discharge start voltage Vth (V). This triggers the bias cleaning of the charging roller 3Ma of magenta (M).

As in the case of yellow (Y), in the case where there has been issued a next image formation instruction after the bias cleaning of the charging roller 3Ma is completed, a voltage whose absolute value is higher than the absolute value of the discharge start voltage Vth (V) is applied once again to the charging brush 3Md. Further, a voltage whose absolute value is lower than the absolute value of the discharge start voltage Vth (V) is applied once again to the charging roller 3Ma. As a result, the image carrier 2M is uniformly charged for the next image formation operation. In the case where there has not been issued a next image formation instruction, i.e., the current image formation operation is the last one, the voltages applied to the charging brush 3Md and charging roller 3Ma are turned off, that is, no voltage is applied to these charging members. Therefore, charging operation for the surface of the image carrier 2Y of magenta (M) for image formation is not performed.

In the same manner as described above, the bias cleaning of the charging roller 3Ca of cyan (C) and charging roller 3Ka of black (K) are sequentially performed. Thereafter, irrespective of whether a next image formation instruction has been issued or not, the control operations for application voltage to the charging brushes 3Cd and 3Kd and charging rollers 3Ca and 3Ka are performed. When the image formation operation has completely ended, the image carriers 2Y, 2M, 2C, 2K of all colors are stopped.

According to the image forming apparatus 1, at the time of forming the respective images, a voltage whose absolute value is higher than the absolute value of the discharge start voltage Vth is applied to the charging brushes 3Yd, 3Md, 3Cd, 3Kd, and a voltage whose absolute value is lower than the absolute value of the discharge start voltage Vth and whose absolute value is lower than the absolute value of the application voltage to the charging brushes 3Yd, 3Md, 3Cd, 3Kd is applied to the charging rollers 3Ya, 3Ma, 3Ca, 3Ka. Further, at the time of cleaning the charging rollers 3Ya, 3Ma, 3Ca, 3Ka of respective colors (at the time when an image is not formed), a voltage whose absolute value is lower than the absolute value of the discharge start voltage Vth is applied to the charging brushes 3Yd, 3Md, 3Cd, 3Kd, and a voltage whose absolute value is higher than the absolute value of the discharge start voltage Vth and whose absolute value is higher than the absolute value of the application voltage to the charging brushes 3Yd, 3Md, 3Cd, 3Kd is applied to the charging rollers 3Ya, 3Ma, 3Ca, 3Ka. That is, the magnitude relation in the absolute values of the application voltages to the charging brushes 3Yd, 3Md, 3Cd, 3Kd and charging rollers 3Ya, 3Ma, 3Ca, 3Ka is reversed between at the image formation time and at the time of cleaning. As a result, foreign matters such as residual toner adhered to the charging rollers 3*a* can be removed therefrom and moved to the corresponding image carriers 2Y, 2M, 2C, 2K. This allows achievement of satisfactory charge of the image carriers 2Y, 2M, 2C, 2K over a long period of time, thereby effectively realizing high quality image formation.

In addition, at the time of cleaning the charging rollers 3Ya, 3Ma, 3Ca, 3Ka, the surface potentials of the respective image carriers 2Y, 2M, 2C, 2K brought into contact with the charging rollers 3Ya, 3Ma, 3Ca, 3Ka can be maintained at a constant value. This prevents formation of a charged part and non-charged part on the respective image carriers 2Y, 2M, 2C, 2K, making the electrostatic adsorption forces between the image carriers 2Y, 2M, 2C, 2K and intermediate transfer belt 8 substantially equal to one another. As a result, a difference is not caused in moving speed of the intermediate transfer belt 8, thereby preventing banding and resist shift.

Figure 7:
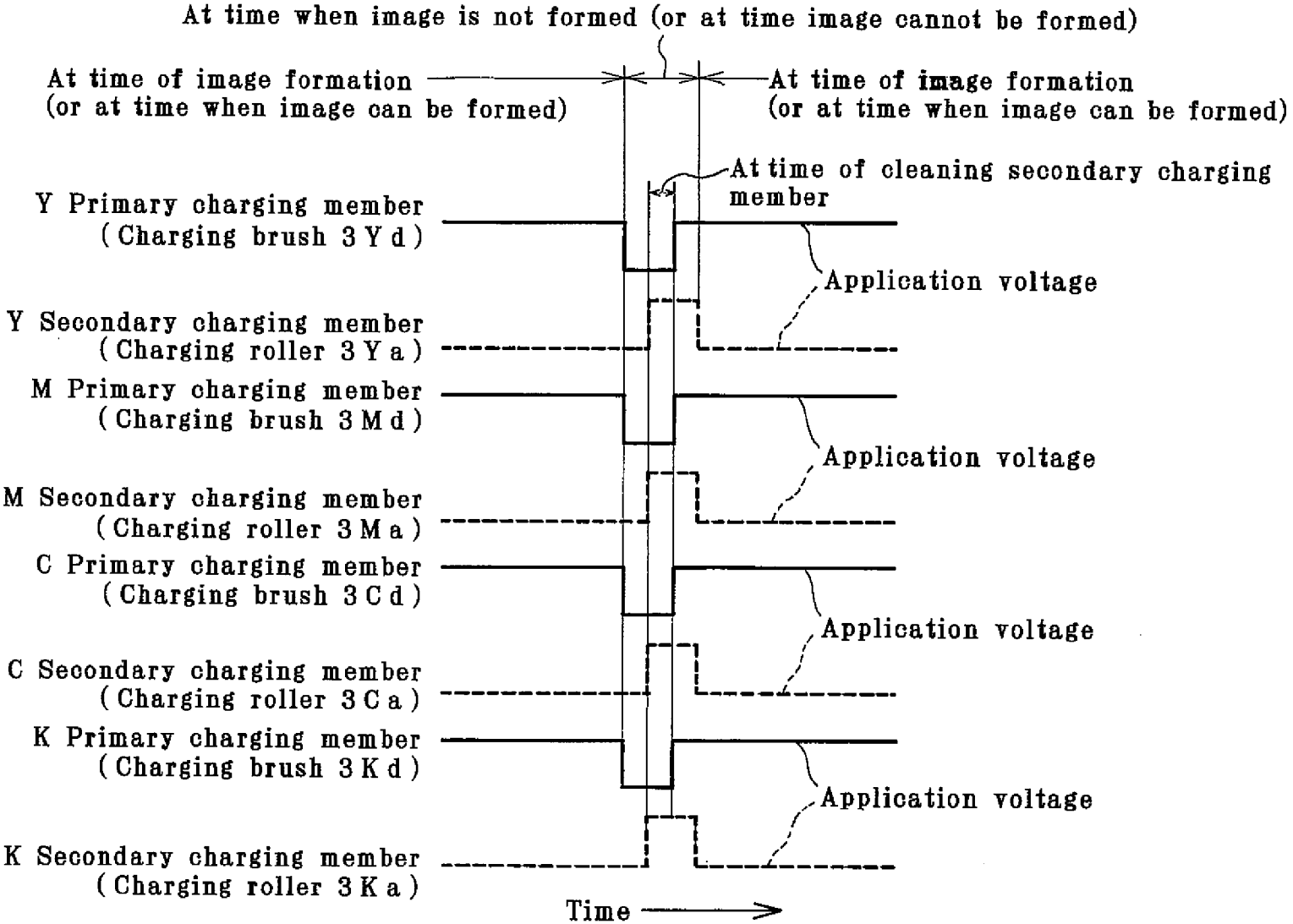
FIG. 7 is a timing chart in the case where bias cleaning is conducted after an image of all colors has been formed.

FIG. 7 is a timing chart in the case where the bias cleaning is conducted according to the flowchart of FIG. 4 after an image of all colors has been formed in the tandem type image forming apparatus of FIG. 1.

In the bias cleaning of the charging roller shown in FIG. 6, bias cleaning of the charging rollers of respective colors are sequentially performed every time an image of one color has been formed (written). On the other hand, in this image forming apparatus 1 of this example, bias cleaning of the charging rollers 3Ya, 3Ma, 3Ca, 3Ka are performed simultaneously after an image of all colors has been formed (written).

That is, as shown in FIG. 7, in the image forming apparatus 1 of this example, at the time of image formation (or at the time when an image can be formed), a voltage whose absolute value is higher than the absolute value of the discharge start voltage Vth (V) is applied to the respective charging brushes (primary charging members) 3Yd, 3Md, 3Cd, 3Kd, and a voltage whose absolute value is lower than the absolute value of the discharge start voltage Vth (V) is applied to the respective charging rollers (secondary charging members) 3Ya, 3Ma, 3Ca, 3Ka. Then, the image formation operations of respective colors are sequentially started.

In the image forming apparatus of this example, even after the image formation operations (primary transfer operations) of yellow (Y), magenta (M), and cyan (C) have been completed, bias cleaning of the charging rollers of these colors are not started if the image formation operation of black (K) has not been completed. When the image formation operation of black (K) has been completed, bias cleaning of the charging rollers 3Ya, 3Ma, 3Ca, 3Ka of all colors are performed simultaneously according to the processing of steps S7 and S8 shown in the flowchart of FIG. 4.

In the case where there has been issued a next image formation instruction after the simultaneous bias cleaning of the charging rollers 3Ya, 3Ma, 3Ca, 3Ka of all colors are completed, the image formation operation and simultaneous bias cleaning are performed once again. In the case where there has not been issued a next image formation instruction after the simultaneous bias cleaning of the charging rollers of all colors are completed, i.e., image formation operation completely ends, voltages applied to all the charging brushes 3Yd, 3Md, 3Cd, 3Kd and all the charging rollers 3Ya, 3Ma, 3Ca, 3Ka are turned off, that is no voltage is applied to these charging members. Therefore, charging operation for the surface of the image carriers 2Y, 2M, 2C, 2K of all colors for image formation is not performed. When the image carriers 2Y, 2M, 2C, 2K of all colors are stopped, image formation operation has completely ended.

In the image formation apparatus 1 of this example, it is possible to obtain the same advantage as that of the example shown in FIG. 6.

The bias cleaning methods for cleaning the respective charging rollers 3Ya, 3Ma, 3Ca, 3Ka shown in FIGS. 6 and 7 can be applied not only to the tandem type image forming apparatus 1 of FIG. 1 but also to a 4-cycle full color image forming apparatus in which one image carrier makes one rotation for each development operation and transfer operation of one color. In the 4-cycle full color image forming apparatus, it is possible to obtain the same advantage as that of the example shown in FIG. 6.

Next, a description will be given of experiments made for confirming the advantage obtained by the present invention.

(Experimental Apparatus)

As an experimental apparatus, a commercially available color laser printer, LP9000C, manufactured by Seiko Epson Corporation was used. A charger of a photoconductor unit for LP-9000C was partially modified so that the charging brush 3*d* (as primary charging member) and charging roller 3*a* (as secondary charging member) can be attached thereto. The charging brush shown in Table 1 was used as the charging brush 3*d*, and above-mentioned charging roller taken as an example was used as the charging roller 3*a*. Further, the configuration was made such that a voltage can externally be applied to the charging brush 3*d* and charging roller 3*a* and voltage control can externally be made. The discharge start voltages Vth of both the charging brush 3*d* and charging roller 3*a* were −570 V. Further, the LP9000C was modified so that bias cleaning of the charging rollers 3*a* of respective colors shown in FIG. 6 can be performed. Other components including a photoconductor drum, a cleaning blade, an optical writing unit, a development unit (including genuine toner), a transfer unit (including transfer belt), and a fixing unit were original parts of the printer LP9000C. Experiments were conducted according to Examples 1 to 5 and Comparative examples 1 to 4 shown in Table 2.

TABLE 2

| | CB application voltage at cleaning time (−V) | CR application voltage at cleaning time (−V) | Surface potential of image carrier at image formation time (−V) | Presence/ absence of banding |
|---|---|---|---|---|
| Example 1 | 0 | 1400 | 812 | Absent |
| Example 2 | 0 | 1200 | 620 | Absent |
| Example 3 | 0 | 1000 | 401 | Absent |
| Example 4 | 0 | 800 | 198 | Absent |
| Example 5 | 0 | 650 | 55 | Absent |
| Comparative example 1 | 0 | 500 | 17 | Present |
| Comparative example 2 | 0 | 400 | 15 | Present |
| Comparative example 3 | 0 | 200 | 8 | Present |
| Comparative example 4 | 0 | 0 | 0 | Present |

The following experimental conditions are commonly used in Examples 1 to 5 and Comparative examples 1 to 4: Charging voltage applied to the charging brush 3*d* (primary charging member) is −1500 V (DC voltage); charging voltage applied to the charging roller 3*a* (secondary charging member) is −50 V (DC voltage); process speed is 210 mm/sec; peripheral speed ratio between the charging roller and photoconductor is 1; development voltage is superimposed voltage of DC voltage ($V_{DC}$=−200 V) and AC voltage ($V_{PP}$=1400 V, rectangular waveform having frequency f=3.0 KHz (50% duty)); and transfer voltage is +200 V.

(Image Formation Test)

The same image formation test was carried out on Examples 1 to 5 and Comparative examples 1 to 4. That is, 2 sheets (A4 size, regular paper) of monochrome halftone image were printed out successively under a room temperature (23° C.). After the test, the obtained images were visually confirmed to determine presence/absence of banding. In the case of absence of banding, it was determined that charge was performed satisfactorily; while in the case of presence of banding, it was determined that charge was performed unsatisfactorily.

Individual experimental conditions of the Examples 1 to 5 and Comparative examples 1 to 4 will be described below. These individual experimental conditions are listed in Table 2.

Example 1

As shown in Table 2, a DC voltage of −1400 V whose absolute value is higher than the absolute value of the discharge start voltage Vth (V) was applied to the charging roller 3*a* at the time of bias cleaning and a DC voltage of 0 V whose absolute value is lower than the absolute value of the discharge start voltage Vth (V) was applied to the charging brush 3*d*. The surface potential of the image carrier at this time was −812 V.

Example 2

As shown in Table 2, a DC voltage of −1200 V whose absolute value is higher than the absolute value of the discharge start voltage Vth (V) was applied to the charging roller 3*a* at the time of bias cleaning and a DC voltage of 0 V whose absolute value is lower than the absolute value of the discharge start voltage Vth (V) was applied to the charging brush 3*d*. The surface potential of the image carrier at this time was −620 V.

Example 3

As shown in Table 2, a DC voltage of −1000 V whose absolute value is higher than the absolute value of the discharge start voltage Vth (V) was applied to the charging roller 3*a* at the time of bias cleaning and a DC voltage of 0 V whose absolute value is lower than the absolute value of the discharge start voltage Vth (V) was applied to the charging brush 3*d*. The surface potential of the image carrier at this time was −401 V.

Example 4

As shown in Table 2, a DC voltage of −800 V whose absolute value is higher than the absolute value of the discharge start voltage Vth (V) was applied to the charging roller 3*a* at the time of bias cleaning and a DC voltage of 0 V whose absolute value is lower than the absolute value of the discharge start voltage Vth (V) was applied to the charging brush 3*d*. The surface potential of the image carrier at this time was −198 V.

Example 5

As shown in Table 2, a DC voltage of −650 V whose absolute value is higher than the absolute value of the discharge start voltage Vth (V) was applied to the charging roller 3*a* at the time of bias cleaning and a DC voltage of 0 V whose absolute value is lower than the absolute value of the discharge start voltage Vth (V) was applied to the charging brush 3*d*. The surface potential of the image carrier at this time was −55 V.

Comparative Example 1

As shown in Table 2, a DC voltage of −500 V whose absolute value is lower than the absolute value of the discharge start voltage Vth (V) was applied to the charging roller 3*a* at the time of bias cleaning and a DC voltage of 0 V whose absolute value is lower than the absolute value of the discharge start voltage Vth (V) was applied to the charging brush 3*d*. The surface potential of the image carrier at this time was −17 V.

Comparative Example 2

As shown in Table 2, a DC voltage of −400 V whose absolute value is lower than the absolute value of the discharge start voltage Vth (V) was applied to the charging roller 3*a* at the time of bias cleaning and a DC voltage of 0 V whose absolute value is lower than the absolute value of the discharge start voltage Vth (V) was applied to the charging brush 3*d*. The surface potential of the image carrier at this time was −15 V.

Comparative Example 3

As shown in Table 2, a DC voltage of −200 V whose absolute value is lower than the absolute value of the discharge start voltage Vth (V) was applied to the charging roller 3*a* at the time of bias cleaning and a DC voltage of 0 V whose absolute value is lower than the absolute value of the discharge start voltage Vth (V) was applied to the charging brush 3*d*. The surface potential of the image carrier at this time was −8 V.

Comparative Example 4

As Shown in Table 2, a DC Voltage of 0 V Whose Absolute value is lower than the absolute value of the discharge start voltage Vth (V) was applied to the charging roller 3*a* at the time of bias cleaning and a DC voltage of 0 V whose absolute value is lower than the absolute value of the discharge start voltage Vth (V) was applied to the charging brush 3*d*. The surface potential of the image carrier at this time was −0 V.

The experiment results are shown in Table 2. As is clear from Table 2, banding did not occur and satisfactory charge state was obtained in Examples 1 to 5. Whereas, the banding occurred and charge state became unsatisfactory in Comparative examples 1 to 4.

As a result, it was confirmed that the intended effects can be obtained according to the present invention.

Although the case where the present invention is applied to the image processing apparatus which negatively charges the image carrier 2 by means of the charger 3 at the time of image formation has been explained in the above embodiment, the present invention can also be applied to an image forming apparatus which positively charges the image carrier 2 by means of the charger 3 at the time of image formation. The magnitude relation in the absolute values of the application voltages to the charging roller 3*a* and charging brush 3*d* at the image formation time, and magnitude relation in the absolute values of the application voltages to the charging roller 3*a* and charging brush 3*d* at the bias cleaning time are the same as those in the case where the image carrier 2 is negatively charged. In this case, the abovementioned advantages of the present invention can be obtained.

The primary charging member is not limited to the charging brush 3*d* but may be another different charging member such as a charging roller or charging brush roller. The secondary charging member is not limited to the charging roller 3*a* but may be another different charging member such as a charging brush or charging brush roller.

Although the discharge start voltage of the charging roller 3*a* and that of the charging brush 3*d* are made equal to each other in the charger 3 of the above examples, the discharge start voltage may differ between the charging roller 3*a* and charging brush 3*d*.

Although the transfer belt used in the present invention is applied to the intermediate transfer belt 8 onto which a toner image is primary transferred from the image carrier 2 and from which the transferred toner image is secondary transferred onto a transfer material such as a paper sheet in the image forming apparatus 1 of the above examples. However, the transfer belt used in the present invention is not limited to this but may be a transfer belt for feeding a transfer material such as a paper onto which a toner image on the image carrier 2 is directly transferred.

What is claimed is:

1. A charger comprising:

a first charging member which is brought into contact with an image carrier to charge a surface of the image carrier;

a second charging member which is brought into contact with the image carrier at a portion on a downstream side relative to the first charging member in a rotational direction of the image carrier to charge the surface of the image carrier; and a controller which controls voltages applied to the first and second charging members, wherein at the time of image formation, the controller applies, to the first charging member, a voltage whose absolute value is higher than the absolute value of a discharge start voltage of the first charging member and applies, to the second charging member, a voltage whose absolute value is lower than the absolute value of a discharge start voltage of the second charging member and whose absolute value is lower than the voltage applied to the first charging member, and at the time when an image is not formed, the controller applies, to the first charging member, a voltage whose absolute value is lower than the absolute value of the discharge start voltage of the first charging member and applies, to the second charging member, a voltage whose absolute value is higher than the absolute value of the discharge start voltage of the second charging member and whose absolute value is higher than the voltage applied to the first charging member.

2. The charger according to claim 1, wherein the first charging member is a charging brush, a charging roller, or a charging brush roller.

3. An image forming apparatus comprising at least:

an image carrier which is rotatably provided and on the surface of which an electrostatic latent image is formed;

a charger that charges the image carrier;

a writing unit that writes the electrostatic latent image onto the image carrier;

a developing unit that develops the electrostatic latent image formed on the image carrier so as to form a developer image onto the image carrier; and a transfer unit that transfers the developer image on the image carrier onto a transfer belt, wherein the charger is the charger as claimed in claim 1 or claim 2.

4. The image forming apparatus according to claim 3, wherein a plurality of sets each including the image carrier, charger, writing unit, developing unit, and transfer unit are provided on a color-by-color basis and arranged in tandem, and the transfer belt is brought into contact with the image carriers for respective colors.

5. The image forming apparatus according to claim 3, wherein the development units for respective colors are disposed near the image carrier to develop the electrostatic latent image on the image carrier to form a developer image, which is transferred onto a transfer belt in multiple processing cycles of the transfer belt.

6. A charge control method comprising the steps of:

charging a surface of an image carrier by means of a first charging member which is brought into contact with the image carrier;

charging the surface of an image carrier by means of a second charging member which is brought into contact with the image carrier at a portion on a downstream side relative to the first charging member in a rotational direction of the image carrier, wherein at the time of image formation, a voltage whose absolute value is higher than the absolute value of a discharge start voltage of the first charging member is applied to the first charging member, and a voltage whose absolute value is lower than the absolute value of a discharge start voltage of the second charging member and whose absolute value is lower than the voltage applied to the first charging member is applied to the second charging member, and at the time when an image is not formed, a voltage whose absolute value is lower than the absolute value of the discharge start voltage of the first charging member is applied to the first charging member, and a voltage whose absolute value is higher than the absolute value of the discharge start voltage of the second charging member and whose absolute value is higher than the voltage applied to the first charging member is applied to the second charging member.

* * * * *